US007825751B2

(12) United States Patent
Kawaguchi et al.

(10) Patent No.: US 7,825,751 B2
(45) Date of Patent: Nov. 2, 2010

(54) RESONANT CIRCUIT, FILTER CIRCUIT, AND ANTENNA DEVICE

(75) Inventors: Tamio Kawaguchi, Kawasaki (JP); Fumihiko Aiga, Yokohama (JP); Hiroyuki Kayano, Fujisawa (JP); Noritsugu Shiokawa, Yokohama (JP); Tatsunori Hashimoto, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/751,208

(22) Filed: May 21, 2007

(65) Prior Publication Data

US 2008/0055181 A1 Mar. 6, 2008

(30) Foreign Application Priority Data

May 24, 2006 (JP) ..... 2006-143602

(51) Int. Cl.
*H01P 1/20* (2006.01)

(52) U.S. Cl. ..... 333/202; 333/219.1; 333/230

(58) Field of Classification Search ..... 330/202–208, 330/230; 333/202–212, 230, 219.1, 132–134, 333/168–185, 995, 204, 219
See application file for complete search history.

(56) References Cited

U.S. PATENT DOCUMENTS 5,608,363 A * 3/1997 Cameron et al. ..... 333/202
5,805,034 A * 9/1998 Evans et al. ..... 333/204
6,300,849 B1 10/2001 Takeda et al.
6,370,404 B1 * 4/2002 Shen ..... 505/210
6,496,710 B1 12/2002 Tsuzuki
6,529,750 B1 * 3/2003 Zhang et al. ..... 505/210
6,633,207 B1 * 10/2003 Hidaka et al. ..... 333/134
6,734,760 B2 * 5/2004 Tsujiguchi ..... 333/172
7,215,225 B2 5/2007 Fuke et al.
7,471,173 B2 * 12/2008 Hidaka et al. ..... 333/204
2004/0233022 A1 11/2004 Tsuzuki et al.
2005/0007210 A1 1/2005 Fuke et al.

FOREIGN PATENT DOCUMENTS

| | | |
|---|---|---|
| JP | 2000-341071 | 12/2000 |
| JP | 2001-308603 | 11/2001 |
| JP | 2004-530391 | 9/2004 |
| JP | 2004-349966 | 12/2004 |
| JP | 2005-265721 | 9/2005 |

* cited by examiner

*Primary Examiner*—James H. Cho
*Assistant Examiner*—Christopher Lo
(74) *Attorney, Agent, or Firm*—Oblon, Spivak, McClelland, Maier & Neustadt, L.L.P.

(57) ABSTRACT

In resonant elements 102 to 105 constituting a resonant circuit, an uncontrolled cross coupling which exists between two resonant elements is controlled by using a coupling element 106 which is newly arranged between the resonant elements, whereby it is possible to create a state where two resonant elements are not coupled with each other or a state where the amount of the coupling is reduced, which states are difficult to be realized on a plane. As a result, it is possible to improve characteristics of a planar filter.

6 Claims, 7 Drawing Sheets

RESONANT CIRCUIT, FILTER CIRCUIT, AND ANTENNA DEVICE

CROSS REFERENCE TO RELATED APPLICATIONS

This application is based upon and claims the benefit of priority from the prior Japanese Patent Applications No. 2006-143602, filed on May 24, 2006; the entire contents of which are incorporated herein by reference.

BACKGROUND OF THE INVENTION

1. Field of the Invention

The present invention relates to a resonant circuit, a filter circuit, and an antenna device.

2. Related Art

A communication apparatus which performs information communication by radio or wire is constituted by various high frequency components such as an antenna, an amplifier, a mixer, and a filter. Among these components, a band pass filter (BPF), in which a plurality of resonant elements are arranged, has a function of passing only a signal in a specific frequency band. In today's communication systems, from a viewpoint of effective use of frequency, a sharp cut-off characteristic is preferred as a filter characteristic so as to enable the maximum use of the available band width. Further, to meet a demand for miniaturization of communication apparatuses, a filter having a smaller size is preferred.

In order to realize the filter characteristics, it is necessary to make a plurality of resonant elements coupled by electromagnetic fields, and the circuit constant of the filter consists of the resonant frequency fi of each resonant element, the coupling coefficient between resonant elements Mij, and the external quality factor Qe.

Methods for realizing the coupling coefficient between resonant elements in a filter circuit can be roughly classified into the following two kinds. The first method is a gap coupling by which a desired coupling is realized only on the basis of the positional relation between resonant elements without adding a coupling element in addition to the resonant elements. The gap coupling is suitable for a filter circuit which is constituted only by the coupling between adjacent resonant elements, such as in the Chebyshev's function type filter. The second method is a cross coupling by which a coupling is realized by adding a transmission line as described in the Patent Document 1 and the Patent Document 2. The cross coupling is suitable for a filter circuit which makes the steep skirt characteristics by the attenuation pole, and improving the planarity in group delay.

In a planar filter in which all resonant elements are arranged on a same plane, it is difficult to take a sufficient interval between adjacent resonant elements when promoting the miniaturization of the filter, as a result of which undesirable cross couplings exist in addition to desired couplings. By the influence of the undesirable cross couplings, the filter performance or the symmetry of the filter cut-off characteristic is deteriorated, which is one of the causes of the difficulty in realizing the filter characteristics.

As a measure against the undesirable cross coupling, there are a method for making the magnitude of the undesirable cross coupling small by devising the shape and arrangement of the resonant elements, and a method for effecting electromagnetic shielding between resonant elements which are coupled with each other by an undesirable cross coupling, by inserting a metal plate or the like between the resonant elements, as described in the Patent Document 3 and the Patent Document 4.

Patent Document 1: JP-A 2004-530391 (Kokai)
Patent Document 2: JP-A 2000-341071 (Kokai)
Patent Document 3: JP-A 2001-308603 (Kokai)
Patent Document 4: JP-A 2004-349966 (Kokai)

As described above, the undesirable cross coupling is not controlled by the prior art, and in the case where there are structural restrictions, such as those in miniaturizing a filter and an antenna, there are problems that the filter characteristic, the voltage standing wave ratio (VSWR), and the gain of the antenna are deteriorated by the undesirable cross coupling.

An object of the present invention is to provide a resonant circuit, a filter circuit, and an antenna device, in which the above described performance is improved by eliminating the above described disadvantages of the prior art, and by controlling the uncontrolled cross coupling between resonant elements which constitute the filter and the antenna.

SUMMARY OF THE INVENTION

A resonant circuit according to an aspect of the present invention, in which resonant elements of a plurality of orders of at least four or more are arranged by forming a predetermined conductor pattern on a dielectric substrate, is characterized in that among the resonant elements of the plurality of orders, a first to fourth resonant elements forming a desired four orders are arranged so as to effect electromagnetic field couplings between the first and second resonant elements, between the second and third resonant elements, between the third and fourth resonant elements, and between the fourth and first resonant elements, by including at least either a first coupling element which is arranged between the second and fourth resonant elements, in a region on the dielectric substrate except element forming regions in which the resonant elements are formed, so as to intersect a first line segment formed by removing from a line segment connecting a center of gravity of a first region in which the first resonant element is formed to a center of gravity of a third region in which the third resonant element is formed, parts of the line segment included in the first and third regions in which the first and third resonant elements are formed, or a second coupling element which is arranged between the first and third resonant elements, in a region on the dielectric substrate except the element forming regions in which the resonant elements are formed, so as to intersect a second line segment formed by removing from a line segment connecting a center of gravity of a second region in which the second resonant element is formed to a center of gravity of a fourth region in which the fourth resonant element is formed, parts of the line segment included in the second and fourth regions in which the second and fourth resonant elements are formed, and in that electrical lengths of the first and second coupling elements are selected from a range except electrical lengths of integer multiples of a half wavelength of a wavelength in a range corresponding to a frequency range determined on the basis of a center frequency and a band width of the resonant circuit.

Further, a filter circuit according to an aspect of the present invention, in which resonant elements of a plurality of orders of at least four or more, and an input section and an output section which are connected to the feed line, are arranged by forming a predetermined conductor pattern on a dielectric substrate, is characterized in that among the resonant elements of the plurality of orders, a first to fourth resonant elements forming a desired four orders are arranged so as to effect electromagnetic field couplings between the first and second resonant elements, between the second and third resonant elements, between the third and fourth resonant elements, and between the fourth and first resonant elements, by including at least either a first coupling element which is arranged between the second and fourth resonant elements, in a region on the dielectric substrate except element forming regions in which the resonant elements are formed, so as to intersect a first line segment formed by removing from a line segment connecting a center of gravity of a first region in which the first resonant element is formed to a center of gravity of a third region in which the third resonant element is formed, parts of the line segment included in the first and third regions in which the first and third resonant elements are formed, or a second coupling element which is arranged between the first and third resonant elements, in a region on the dielectric substrate except the element forming regions in which the resonant elements are formed, so as to intersect a second line segment formed by removing from a line segment connecting a center of gravity of a second region in which the second resonant element is formed to a center of gravity of a fourth region in which the fourth resonant element is formed, parts of the line segment included in the second and fourth regions in which the second and fourth resonant elements are formed, and in that electrical lengths of the first and second coupling elements are selected from a range except electrical lengths of integer multiples of a half wavelength of a wavelength in a range corresponding to a frequency range determined on the basis of a center frequency and a band width of the resonant circuit.

Further, an antenna device according to an aspect of the present invention, in which resonant elements of a plurality of orders of at least four or more and an input section as a feeding line are arranged by forming a predetermined conductor pattern on a dielectric substrate, is characterized in that among the resonant elements of the plurality of orders, a first to fourth resonant elements forming a desired four orders are arranged to effect electromagnetic field couplings between the first and second resonant elements, between the second and third resonant elements, between the third and fourth resonant elements, and between the fourth and first resonant elements, by including at least either a first coupling element which is arranged between the second and fourth resonant elements, in a region on the dielectric substrate except element forming regions in which the resonant elements are formed, so as to intersect a first line segment formed by removing from a line segment connecting a center of gravity of a first region in which the first resonant element is formed to a center of gravity of a third region in which the third resonant element is formed, parts of the line segment included in the first and third regions in which the first and third resonant elements are formed, or a second coupling element which is arranged between the first and third resonant elements, in a region on the dielectric substrate except the element forming regions in which the resonant elements are formed, so as to intersect a second line segment formed by removing from a line segment connecting a center of gravity of a second region in which the second resonant element is formed to a center of gravity of a fourth region in which the fourth resonant element is formed, parts of the line segment included in the second and fourth regions in which the second and fourth resonant elements are formed, and in that electrical lengths of the first and second coupling elements are selected from a range except electrical lengths of integer multiples of a half wavelength of a wavelength in a range corresponding to a frequency range determined on the basis of a center frequency and a band width of the resonant circuit.

DETAILED DESCRIPTION OF THE INVENTION

In the following, embodiments according to the present invention will be described with reference to the accompanying drawings.

(1) First Embodiment

Figure 1:
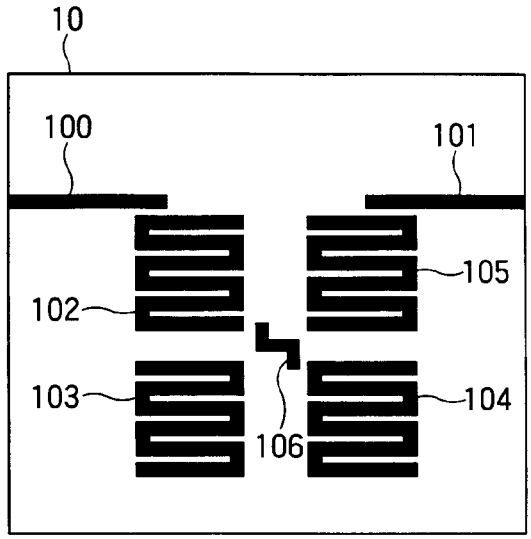
FIG. 1 is a plan view showing a constitution of a filter according to a first embodiment of the present invention.

FIG. 1 shows a filter according to a first embodiment. A filter 10 is connected to the feed line by transmission lines of an input section 100 and an output section 101, and has four resonant elements 102, 103, 104 and 105. The resonant element is capable of taking various shapes such as a hairpin shape, an open loop shape, and a spiral shape in addition to a meander line shape as shown in FIG. 1. Further, the input and output sections is able to connect the resonant elements directly.

The filter 10 has a dense structure formed in such a manner that these resonant elements 102 to 105 are brought close to each other for miniaturization. The respective resonant elements 102 to 105 are constituted by bending an open ends microstrip line, and have an electrical length which is about an integer multiple of a half wavelength within a frequency range from fc−df/2 to fc+df/2, which is defined by a center frequency fc and a filter band width df according to a filter specification.

The four resonant elements 102, 103, 104 and 105 are numbered counterclockwise from the resonant element 102 in FIG. 1 such that the resonant element 102 is designated as the first resonant element, the resonant element 103 is designated as the second resonant element, the resonant element 104 is designated as the third resonant element, and the resonant element 105 is designated as the fourth resonant element. In the numbering, an arbitrary element is set to be designated as the first resonant element among the four resonant elements, and the other elements are successively numbered clockwise or counterclockwise.

The respective resonant elements 102 to 105 are coupled between the first and second resonant elements, between the second and third resonant elements, between the third and fourth resonant elements, and between the first and fourth resonant elements, so that one block is formed by the four resonant elements. The coupling value between the resonant elements is, for example, approximately $10^{-2}$ to $10^{-5}$, and is controllable by changing the distance between the resonant elements. Each coupling between the resonant elements is effected by the gap coupling based on an interval between the resonant elements, or the cross coupling based on a transmission line.

Since the filter 10 according to the present embodiment has a dense structure in which the four resonant elements 102 to 105 are brought close to each other, there exist uncontrolled cross couplings between the first and third resonant elements and between the second and fourth resonant elements. In order to selectively control the cross couplings, a coupling element 106 for controlling the cross coupling is provided between the first and third resonant elements.

The electrical length t of the coupling element 106, when defined so as to correspond to fc, is set in a range where an electrical length $t_{fc}$ of a half wavelength in a frequency range from fc−df/2 to fc+df/2 which is defined by fc and df, and integer multiples of the electrical length of this range are excluded, and is, for example, set in a range $0° < t < t_{fc}$ and $t_{fc} < t < 2t_{fc}$. With this, the cross coupling is controlled by changing the electrical length and arrangement of the coupling elements.

Note that in this case, one wavelength is calculated by multiplying a reciprocal of a frequency existing in the above described frequency range (for example, a frequency existing in each predetermined step width) by the speed of electromagnetic wave, and has a range corresponding to the above described frequency range.

In an actual filter circuit, the electrical length t of a coupling element can be calculated in such a manner that the dielectric constant of the substrate and the dimension of the line are inputted into an electromagnetic field simulator so as to make the calculation performed. The electrical length of the coupling element 106 shown in FIG. 1 is equal to or less than a half of the electrical length of the resonant element, and the cross coupling between the first and third resonant elements is cancelled by providing the coupling element 106.

Figure 2:
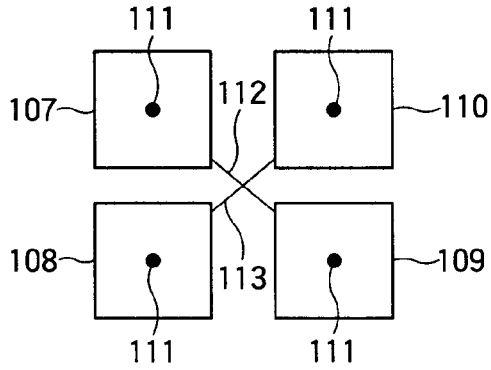
FIG. 2 is a plan view showing an arrangement of resonant elements and coupling elements which form the filter.

On the basis of ranges (regions) 107, 108, 109 and 110 where patterns of the respective resonant elements exist, as shown in FIG. 2, and of centers of gravity 111 which can be obtained in the respective ranges, the coupling element is arranged by using a line segment 112 which is formed by removing from a line segment connecting the center of gravity of the range 107 of the first resonant element to the center of gravity of the range 109 of the third resonant element, parts of the line segment included in the ranges 107 and 109 where the first and third resonant elements exist, and a line segment 113 which is formed by removing from a line segment connecting the center of gravity of the range 108 of the second resonant element to the center of gravity of the range 110 of the fourth resonant element, parts of the line segment included in the ranges 108 and 110 where the second and fourth resonant elements exist. For example, the coupling element which controls the coupling between the first and third resonant elements, is arranged in a place other than the ranges 107, 108, 109 and 110 where the resonant elements exist, so as to intersect the line segment 113.

A range of a resonant element is defined as a range obtained by connecting a plurality of apexes which are selected so as to make the range of the resonant element maximally expanded from an apex of the pattern of the resonant element. In the case where the pattern of the resonant element has a circular form, the range of the resonant element is defined as the range where the pattern exists.

The filter 10 can be made of a conductive material formed on an insulating substrate (not shown) as a dielectric substrate. The insulating substrate has a ground conductor on one face of the substrate, and a line conductor on the opposite face. The conductive material includes metals such as copper and gold, superconductors such as niobium and niobium-tin, and Y system copper oxide high-temperature superconductors. The substrate is made of various suitable materials such as magnesium oxide, sapphire, and lanthanum aluminate. For example, a superconducting microstrip line is formed on a magnesium oxide substrate (not shown) with a thickness of about 0.43 mm and a relative dielectric constant of about 10. Here, a Y system copper oxide high-temperature superconducting thin film having a thickness of about 500 nm is used as the superconductor of the microstrip line, and the line width of the strip conductor is about 0.4 mm. The superconducting thin film can be formed by a laser vapor deposition method, a sputtering method, a co-vapor deposition method, and the like. Further, various suitable structures such as a strip line and a coplanar line, can be adopted as the filter structure in addition to the microstrip line.

Figure 3:
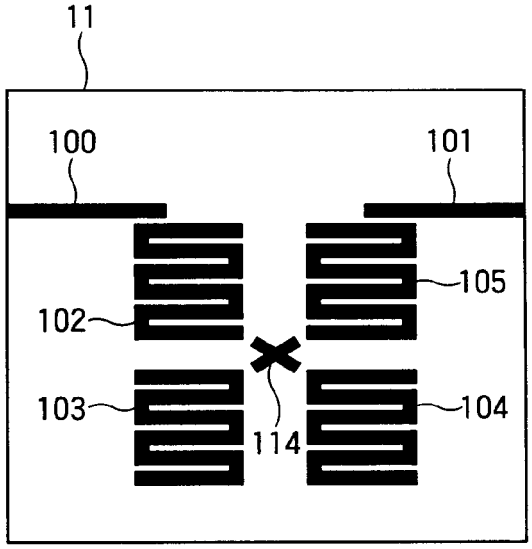
FIG. 3 is a plan view showing a constitution of a filter according to the first embodiment of the present invention.

In a filter 11 shown in FIG. 3, as a measure to the uncontrolled cross couplings between the first and third resonant elements and between the second and fourth resonant elements, a coupling element which controls the coupling between the first and third resonant elements, is arranged in a place other than the ranges 102, 103, 104 and 105 where the resonant elements exist, so as to intersect the line segment 113, and a coupling element which controls the coupling between the second and fourth resonant elements, is arranged in a place other than the ranges 102, 103, 104 and 105 where the resonant elements exist, so as to intersect the line segment 112. As a result, the shape of a coupling element 114 can be made into a shape in which the two coupling elements intersect each other.

The coupling elements 106 and 114 may have various shapes. For example, they may have a line shape opened at both ends, and square, rectangular, cross, circular, elliptic shapes. Alternatively, they may have a line shape with a plurality of open ends, or other suitable shapes.

Figure 4:
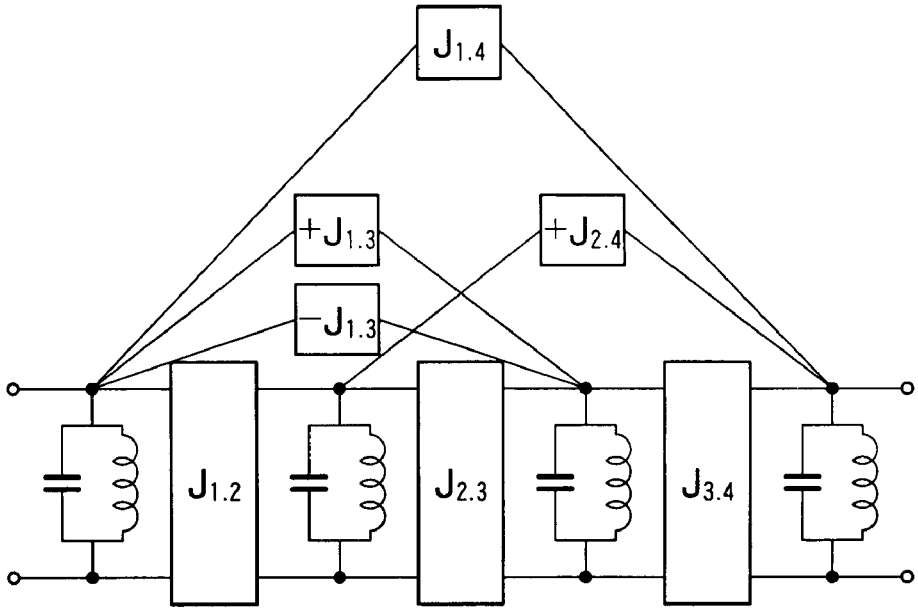
FIG. 4 is a circuit diagram showing an equivalent circuit of the filter according to the first embodiment of the present invention.

FIG. 4 is a figure in which the coupling relation in the filter 10 in FIG. 1 is represented by an equivalent circuit. Each resonant element is represented by a conductance and an inductance which are connected in parallel to each other, and couplings between the respective resonant elements are represented by J-inverters. Here, the coupling between the first and third resonant elements is selectively cancelled by making the coupling of inverse sign of the coupling element 106 connected in parallel to the coupling between the first and third resonant elements.

Figure 5:
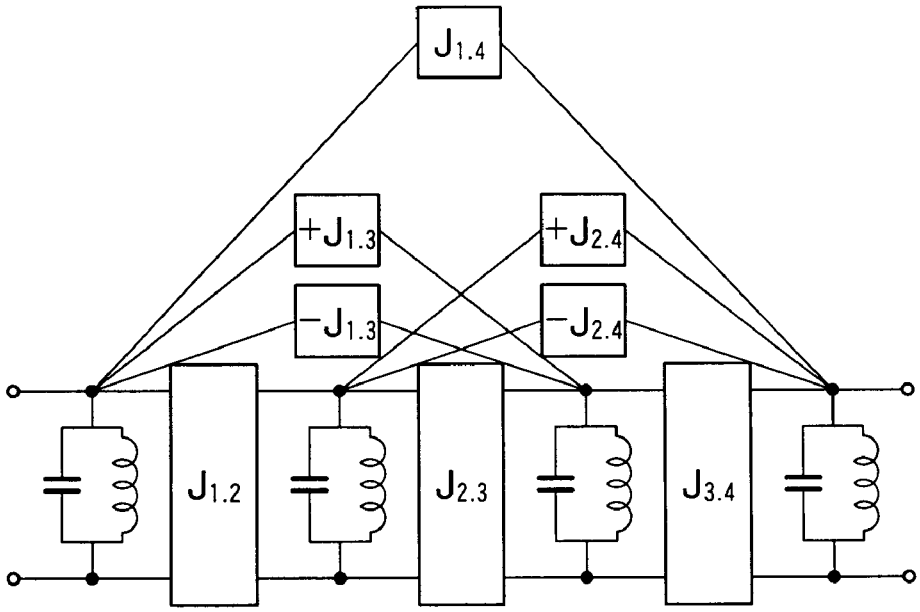
FIG. 5 is a circuit diagram showing an equivalent circuit of the filter.

FIG. 5 is a figure in which the coupling relation in the filter 11 in FIG. 3 is represented by an equivalent circuit. Here, the couplings between the first and third resonant elements and between the second and fourth resonant elements are cancelled by making the couplings of inverse sign of the coupling element 114 connected in parallel to the respective couplings between the resonant elements, as a result of which an ideal filter circuit with only desired couplings can be realized.

Figure 6:
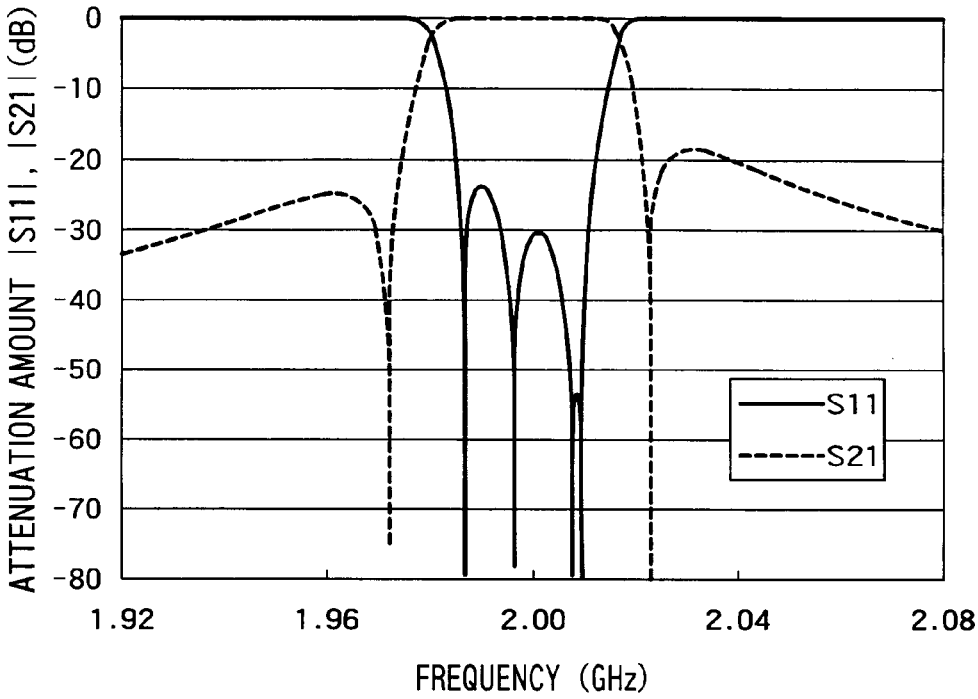
FIG. 6 is an illustration showing frequency characteristics of a filter according to a comparison example.
Figure 7:
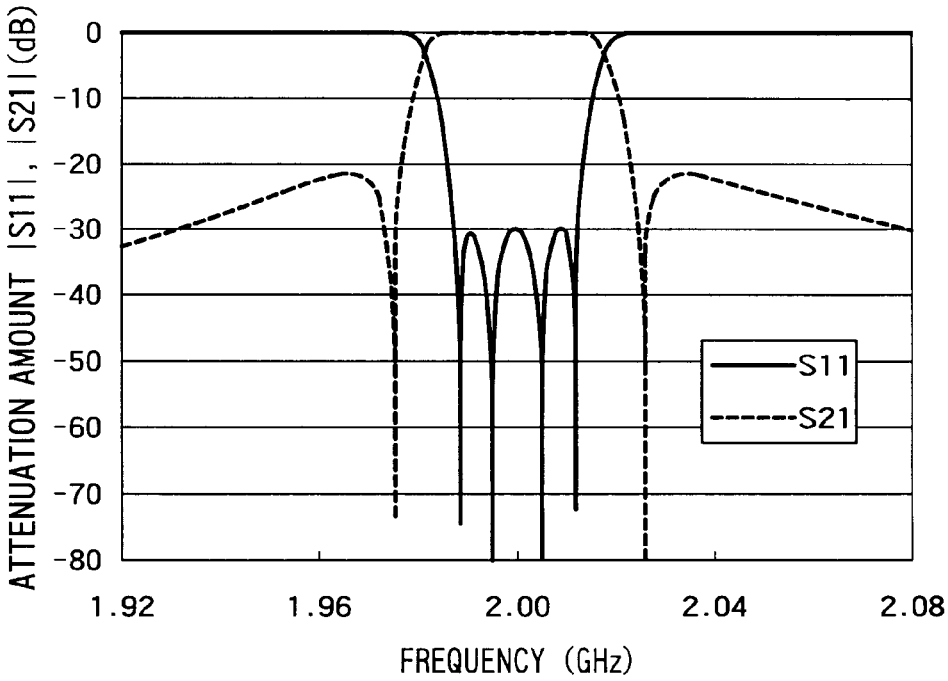
FIG. 7 is an illustration showing frequency characteristics of the filter according to the first embodiment.

FIG. 6 shows filter characteristics in the case where the coupling element 114 is not provided in the filter 11, and cross couplings exist. FIG. 7 shows filter characteristics in the case where the coupling element 114 is provided. The cross couplings are cancelled by the coupling element 114, which makes it possible to improve the filter characteristics and to thereby obtain ideal filter characteristics.

Specifically, in the transmission coefficient S21, it is possible to make the frequency characteristic almost symmetrical with respect to the center frequency of 2.00 GHz, while in the reflection coefficient S11, it is possible to lower the reflection coefficient S11 to approximately −30 dB within a range of band width df around the center frequency of 2.00 GHz.

In this way, according to the present embodiment, the uncontrolled cross couplings, which exist between two resonant elements among the resonant elements 102 to 105 constituting the resonant circuit, are controlled by using the coupling element 106 which is newly arranged between the two resonant elements. As a result, it is possible to create a state where two resonant elements are not coupled with each other or a state where the amount of coupling between the two resonant elements is reduced, which states are difficult to realize on a plane, and to thereby improve the characteristics of a planar filter.

(2) Second Embodiment

Figure 8:
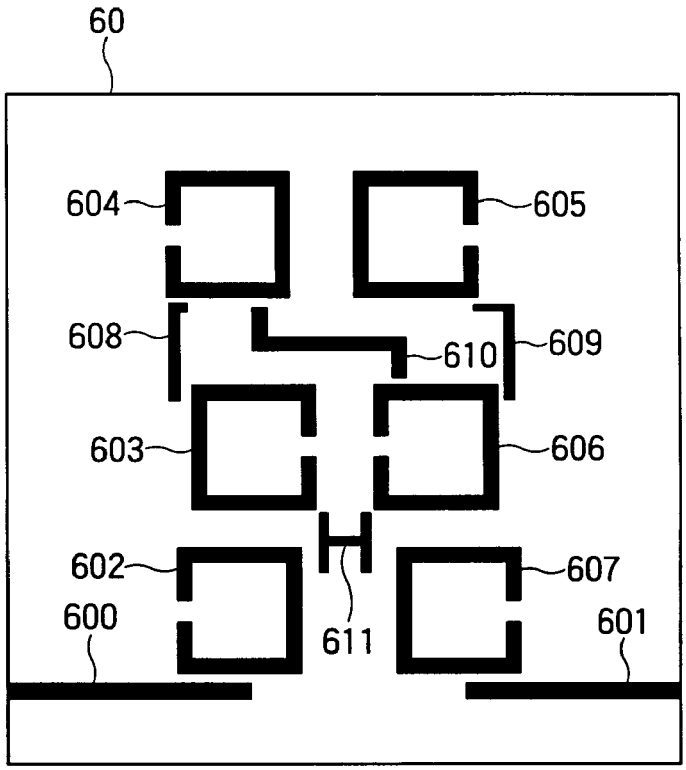
FIG. 8 is a plan view showing a constitution of a filter according to a second embodiment of the present invention.

FIG. 8 shows a filter according to a second embodiment. A filter 60 is connected to the outside by transmission lines of an input section 600 and an output section 601, and is a six-orders filter consisting of six resonant elements 602, 603, 604, 605, 606 and 607. The resonant element has an open loop shape.

The filter 60 has a dense structure in which these resonant elements 602 to 607 are brought close to each other for miniaturization. The respective resonant elements 602 to 607 are constituted by bending an open ends microstrip line, and have an electrical length which is an integer multiple of a half wavelength within a frequency range from fc−df/2 to fc+df/2, which is defined by a center frequency fc and a filter band width df according to a filter specification.

In a block consisting of four resonant elements 603, 604, 605 and 606 which are selected from the six resonant elements 602, 603, 604, 605, 606 and 607, the four resonant elements are numbered counterclockwise from the resonant element 604 on the top left in the figure such that the resonant element 604 is designated as the first resonant element, the resonant element 603 is designated as the second resonant element, the resonant element 606 is designated as the third resonant element, and the resonant element 605 is designated as the fourth resonant element. In the numbering, an arbitrary element is selected from the four resonant elements so as to be designated as the first resonant element, and the other elements are successively numbered clockwise or counterclockwise.

The four resonant elements are selected in such a manner that in the respective resonant elements selected and numbered, the couplings are effected between the first and second resonant elements, between the second and third resonant elements, between the third and fourth resonant elements, and between the first and fourth resonant elements, respectively, and the coupling value between the two resonant elements is, for example, approximately $10^{-2}$ to $10^{-5}$. Further, the four resonant elements are selected in such a manner that a line segment connecting the centers of gravity of the ranges where the first and third resonant elements exist, intersect a line segment connecting the centers of gravity of the ranges where the second and fourth resonant element exist.

Coupling elements 608 and 609 are a coupling element which couples the first resonant element 604 with the second resonant element 603, and a coupling element which couples the third resonant element 606 with the second resonant element 605, respectively. The couplings between the first and second resonant elements, between the second and third resonant elements, between the third and fourth resonant elements, and between the first and fourth resonant elements are effected by the gap coupling based on an interval between the resonant elements or the cross coupling based on a transmission line.

Since the filter 60 according to the present embodiment has a dense structure in which the resonant elements 603 to 606 are brought close to each other, there exist uncontrolled cross couplings between the first and third resonant elements, and between the second and fourth resonant elements. In order to selectively control the magnitude of the cross couplings, for example, a coupling element 610 for controlling the cross coupling is provided between the first and third resonant elements.

The electrical length t of the coupling element 610, when defined so as to correspond to fc, is set in a range where an electrical length $t_{fc}$ of a half wavelength in a frequency range from fc−df/2 to fc+df/2 which is defined by fc and df, and integer multiples of the electrical length of this range are excluded, and is, for example, set in a range $0° < t < t_{fc}$ and $t_{fc} < t < 2t_{fc}$. With this, the cross coupling is controlled by changing the electrical length and arrangement of the coupling elements.

In a block consisting of four resonant elements 602, 603, 606 and 607 which are selected from the six resonant elements 602, 603, 604, 605, 606 and 607, the four resonant elements are numbered counterclockwise from the resonant element 603 on the top left in the figure such that the resonant element 603 is designated as the first resonant element, the resonant element 602 is designated as the second resonant element, the resonant element 607 is designated as the third resonant element, and the resonant element 606 is designated as the fourth resonant element. In the respective resonant elements 602, 603, 606 and 607 which are selected and numbered, the couplings between the first and second resonant elements, between the second and third resonant elements, between the third and fourth resonant elements, and between the first and fourth resonant elements are effected, respectively. The coupling value between the two resonant elements is, for example, approximately $10^{-2}$ to $10^{-5}$.

In order to control the magnitude of the uncontrolled cross couplings between the first and third resonant elements and between the second and fourth resonant elements, a coupling element 611 for controlling the cross coupling is provided. It is possible to control the cross coupling by changing the shape and arrangement of the coupling element 611.

The filter 60 can be made of a conductive material formed on an insulating substrate (not shown) as a dielectric substrate. The insulating substrate has a ground conductor on one face of the substrate, and a line conductor on the opposite face. The conductive material includes metals such as copper and gold, superconductors such as niobium and niobium-tin, and Y system copper oxide high-temperature superconductors. The substrate is made of various suitable materials such as magnesium oxide, sapphire, and lanthanum aluminate. For example, a superconducting microstrip line is formed on a magnesium oxide substrate (not shown) with a thickness of about 0.43 mm and a relative dielectric constant of about 10. Here, a Y system copper oxide high-temperature superconducting thin film having a thickness of about 500 nm is used as the superconductor of the microstrip line, and the line width of the strip conductor is about 0.4 mm. The superconducting thin film can be formed by a laser vapor deposition method, a sputtering method, a co-vapor deposition method, and the like.

(3) Third Embodiment

Figure 9:
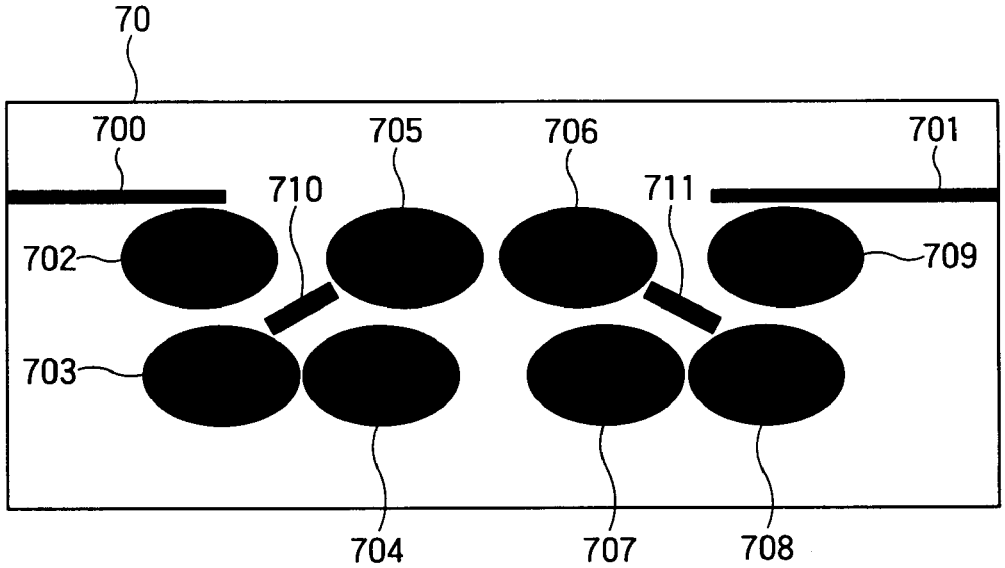
FIG. 9 is a plan view showing a constitution of a filter according to a third embodiment of the present invention.

FIG. 9 shows a filter according to a third embodiment. A filter 70 is connected to the outside by transmission lines of an input section 700 and an output section 701, and is a eight-order filter consisting of eight resonant elements 702, 703, 704, 705, 706, 707, 708 and 709. The resonant element has an elliptic shape, and the filter 70 has a dense structure in which these resonant elements 702 to 709 are brought close to each other. Further, the filter 70 is constituted by two blocks of block 1 which consists of four resonant elements 702, 703, 704 and 705, and block 2 which consists of four resonant elements 706, 707, 708 and 709, and by making the resonant element 705 of the block 1 cascade-connected to the resonant element 706 of the block 2 by the gap coupling.

In the block 1, the four resonant elements are numbered counterclockwise from the resonant element 702 in the figure such that the resonant element 702 is designated as the first resonant element, the resonant element 703 is designated as the second resonant element, the resonant element 704 is designated as the third resonant element, and the resonant element 705 is designated as the fourth resonant element. In the block 2, the four resonant elements are numbered counterclockwise from the resonant element 706 in the figure such that the resonant element 706 is designated as the first resonant element, the resonant element 707 is designated as the second resonant element, the resonant element 708 is designated as the third resonant element, and the resonant element 709 is designated as the fourth resonant element.

In order to selectively control the magnitude of the cross couplings in the filter 70, for example, a coupling element 710 for controlling the cross coupling is provided between the second and fourth resonant elements of the block 1, and a coupling element 711 for controlling the cross coupling is provided between the first and third resonant elements of the block 2. The electrical length t of the coupling elements 710 and 711, when defined so as to correspond to fc, is set in a range where an electrical length $t_{fc}$ of a half wavelength in a frequency range from fc−df/2 to fc+df/2 which is defined by fc and df, and integer multiples of the electrical length of this range are excluded, and is set, for example, in a range $0° < t < t_{fc}$ and $t_{fc} < t < 2t_{fc}$. With this, it is possible to control the cross coupling by changing the electric length and arrangement of the coupling elements. Further, it is possible to selectively control the cross coupling having a great influence on the filter characteristics.

It is also possible to control undesirable cross couplings between the blocks, by providing coupling elements between the third resonant element of the block 1 and the first resonant element of the block 2, between the fourth resonant element of the block 1 and the second resonant element of the block 2, and between the third resonant element of the block 1 and the fourth resonant element of the block 2.

The filter 70 can be made of a conductive material formed on an insulating substrate (not shown) as a dielectric substrate. The insulating substrate has a ground conductor on one face of the substrate, and a line conductor on the opposite face. The conductive material includes metals such as copper and gold, superconductors such as niobium and niobium-tin, and Y system copper oxide high-temperature superconductors. The substrate is made of various suitable materials such as magnesium oxide, sapphire, and lanthanum aluminate. For example, a superconducting microstrip line is formed on a magnesium oxide substrate (not shown) with a thickness of about 0.43 mm and a relative dielectric constant of about 10. Here, a Y system copper oxide high-temperature superconducting thin film having a thickness of about 500 nm is used as the superconductor of the microstrip line, and the line width of the strip conductor is about 0.4 mm. The superconducting thin film can be formed by a laser vapor deposition method, a sputtering method, a co-vapor deposition method, and the like.

Figure 10:
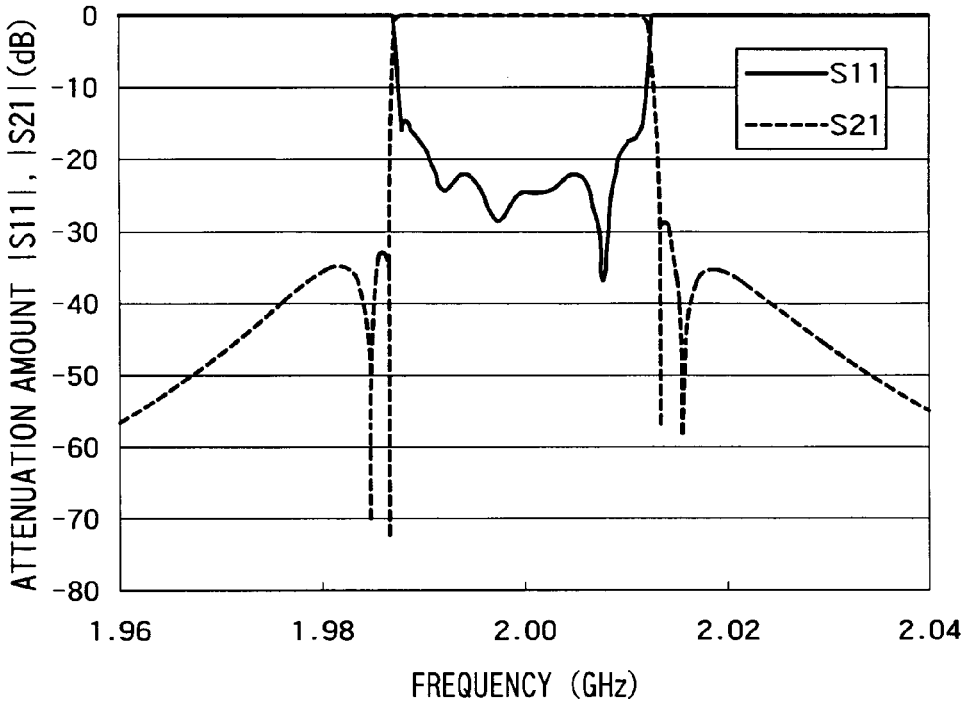
FIG. 10 is an illustration showing frequency characteristics of a filter according to a comparison example.
Figure 11:
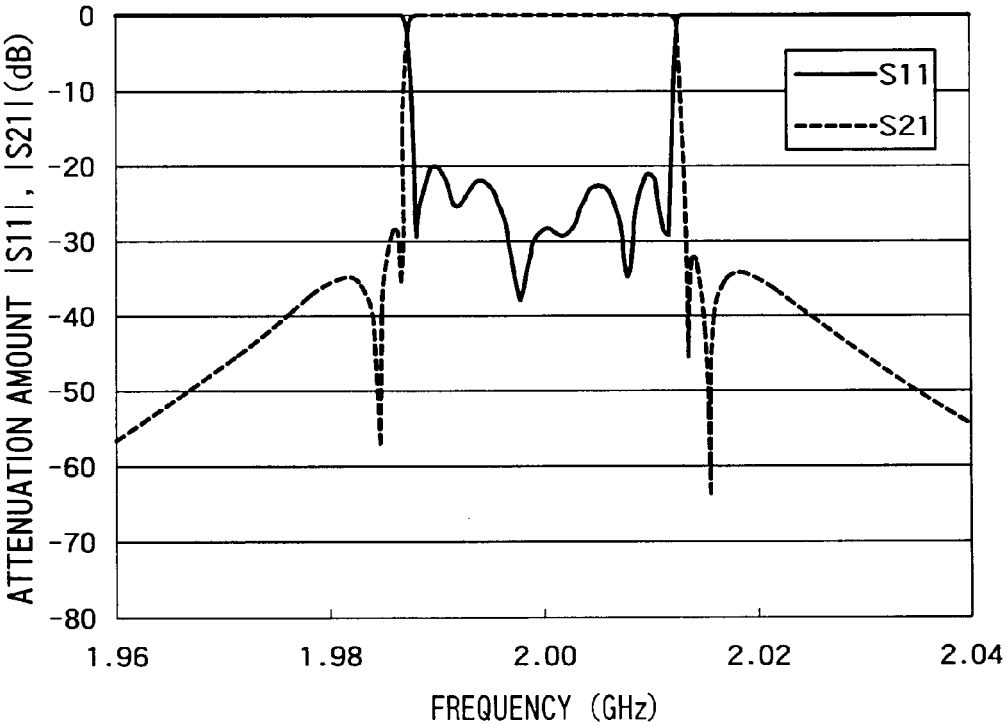
FIG. 11 is an illustration showing frequency characteristics of the filter according to the third embodiment.

FIG. 10 shows filter characteristics in the case where the coupling elements 710 and 711 are not provided in the filter 70, and undesirable cross couplings exist. FIG. 11 shows filter characteristics in the case where the coupling elements 710 and 711 are arranged in the filter 70. The undesirable cross couplings are partially cancelled by the coupling elements 710 and 711, thereby making it possible to improve the filter characteristics.

Specifically, in the transmission coefficient S21, it is possible to make the frequency characteristic almost symmetrical with respect to the center frequency of 2.00 GHz, while in the reflection coefficient S11, it is possible to lower the reflection coefficient S11 to approximately −20 dB within a range of band width df around the center frequency of 2.00 GHz.

(4) Fourth Embodiment

Figure 12:
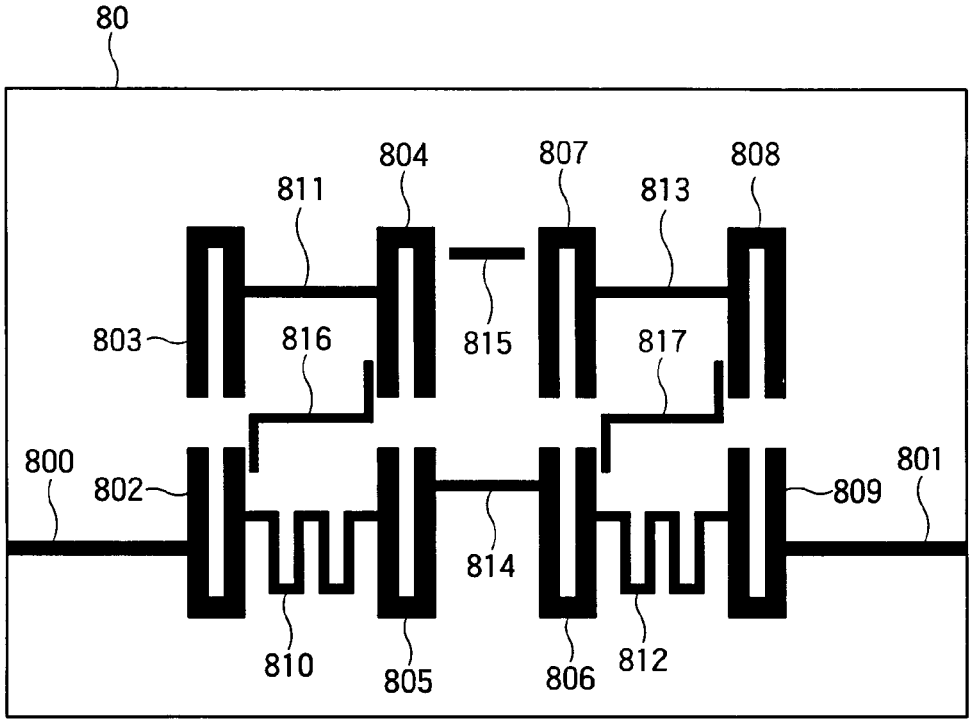
FIG. 12 is a plan view showing a constitution of a filter according to a fourth embodiment of the present invention.

FIG. 12 shows a filter according to a fourth embodiment. A filter 80 is connected to the outside by transmission lines of an input section 800 and an output section 801, and is a eight-order filter consisting of eight resonant elements 802, 803, 804, 805, 806, 807, 808 and 809. Each of the resonant elements has a hairpin structure formed by bending an open ends microstrip line, and has an electrical length which is an integer multiple of a half wavelength within a frequency range from fc−df/2 to fc+df/2, which is defined by a center frequency fc and a filter band width df according to a filter specification.

The filter 80 is constituted by two blocks of block 1 which consists of four resonant elements 802, 803, 804 and 805, and block 2 which consists of four resonant elements 806, 807, 808 and 809, and by making the resonant element 805 of the block 1 cascade-connected to the resonant element 806 of the block 2 by a coupling element 814 for coupling between the blocks. Here, the coupling element 814 is directly connected to the resonant elements to realize the coupling. It is possible to control the magnitude of the coupling by changing the connecting position and the electrical length t of the coupling element.

In the block 1, the four resonant elements are numbered clockwise from the resonant element 802 in the figure such that the resonant element 802 is designated as the first resonant element, the resonant element 803 is designated as the second resonant element, the resonant element 804 is designated as the third resonant element, and the resonant element 805 is designated as the fourth resonant element. Here, in the block 1, the coupling between the first resonant element 802 and the fourth resonant element 805 is realized by a coupling element 810 for coupling between the resonant elements, and the coupling between the second resonant element 803 and the third resonant element 804 is realized by a coupling element 811 for coupling between the resonant elements.

Further, in the block 2, the four resonant elements are numbered clockwise from the resonant element 806 in the figure such that the resonant element 806 is designated as the first resonant element, the resonant element 807 is designated as the second resonant element, the resonant element 808 is designated as the third resonant element, and the resonant element 809 is designated as the fourth resonant element. Here, in the block 2, the coupling between the first resonant element 806 and the fourth resonant element 809 is realized by a coupling element 812 for coupling between the resonant elements, and the coupling between the second resonant element 807 and the third resonant element 808 is realized by a coupling element 813 for coupling between the resonant elements.

In order to selectively control the magnitude of the undesirable cross couplings in the filter 80, for example, a coupling element 816 for controlling the cross coupling is provided between the first and third resonant elements of the block 1, and a coupling element 817 for controlling the cross coupling is provided between the first and third resonant elements of the block 2.

The electrical length t of the coupling elements 816 and 817, when defined so as to correspond to fc, is set in a range where an electrical length $t_{fc}$ of a half wavelength in a frequency range from fc−df/2 to fc+df/2 which is defined by fc and df, and integer multiples of the electrical length of this range are excluded, and is set, for example, in a range $0°<t<t_{fc}$ and $t_{fc}<t<2t_{fc}$. With this, it is possible to control the cross coupling by changing the electrical length and arrangement of the coupling elements.

Further, the undesirable cross couplings between the blocks is controlled by providing a coupling element 815 between the third resonant element of the block 1 and the second resonant element of the block 2.

The filter 80 can be made of a conductive material formed on an insulating substrate (not shown) as a dielectric substrate. The insulating substrate has a ground conductor on one face of the substrate, and a line conductor on the opposite face. The conductive material includes metals such as copper and gold, superconductors such as niobium and niobium-tin, and Y system copper oxide high-temperature superconductors. The substrate is made of various suitable materials such as magnesium oxide, sapphire, and lanthanum aluminate. For example, a superconducting microstrip line is formed on a magnesium oxide substrate (not shown) with a thickness of about 0.43 mm and a relative dielectric constant of about 10. Here, a Y system copper oxide high-temperature superconducting thin film having a thickness of about 500 nm is used as the superconductor of the microstrip line, and the line width of the strip conductor is about 0.4 mm. The superconducting thin film can be formed by a laser vapor deposition method, a sputtering method, a co-vapor deposition method, and the like.

(5) Fifth Embodiment

Figure 13:
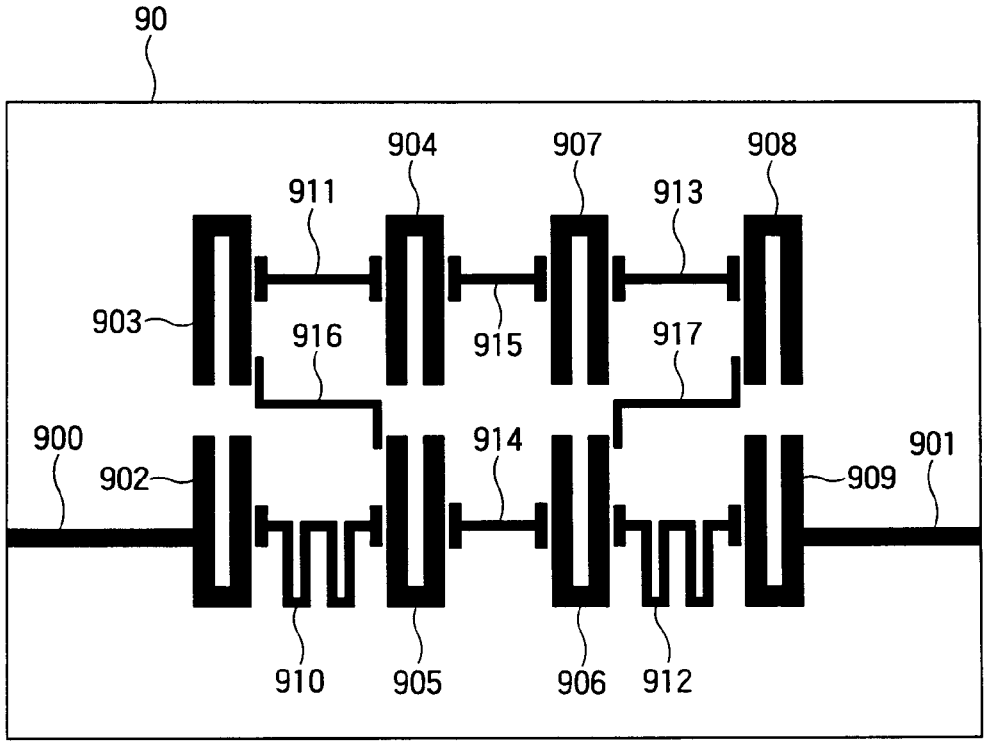
FIG. 13 is a plan view showing a constitution of a filter according to a fifth embodiment of the present invention.

FIG. 13 shows a filter according to a fifth embodiment. A filter 90 is connected to the outside by transmission lines of an input section 900 and an output section 901, and is a eight-order filter consisting of eight resonant elements 902, 903, 904, 905, 906, 907, 908 and 909. Each of the respective resonant elements has a hairpin structure formed by bending an open ends microstrip line, and has an electrical length which is an integer multiple of a half wavelength within a frequency range from fc−df/2 to fc+df/2, which is defined by a center frequency fc and a filter band width df according to a filter specification.

The filter 90 is constituted by two blocks of block 1 which consists of four resonant elements 902, 903, 904 and 905, and block 2 which consists of four resonant elements 906, 907, 908 and 909, and by making the resonant element 905 of the block 1 cascade-connected to the resonant element 906 of the block 2 by a coupling element 914 for coupling between the blocks. It is possible to control the magnitude of the coupling by changing the arranging position and the electrical length t of the coupling element.

In the block 1, the four resonant elements are numbered clockwise from the resonant element 902 in the figure such that the resonant element 902 is designated as the first resonant element, the resonant element 903 is designated as the second resonant element, the resonant element 904 is designated as the third resonant element, and the resonant element 905 is designated as the fourth resonant element. Here, in the block 1, the coupling between the first resonant element 902 and the fourth resonant element 905 is realized by a coupling element 910 for coupling between the resonant elements, and the coupling between the second resonant element 903 and the third resonant element 904 is realized by a coupling element 911 for coupling between the resonant elements.

Further, in the block 2, the four resonant elements are numbered clockwise from the resonant element 906 in the figure such that the resonant element 906 is designated as the first resonant element, the resonant element 907 is designated as the second resonant element, the resonant element 908 is designated as the third resonant element, and the resonant element 909 is designated as the fourth resonant element. Here, in the block 2, the coupling between the first resonant element 906 and the fourth resonant element 909 is realized by a coupling element 912 for coupling between the resonant elements, and the coupling between the second resonant element 907 and the third resonant element 908 is realized by a coupling element 913 for coupling between the resonant elements.

In order to selectively control the magnitude of the undesirable cross couplings in the filter 90, for example, a coupling element 916 for controlling the cross coupling is provided between the second and fourth resonant elements of the block 1, and a coupling element 917 for controlling the cross coupling is provided between the first and third resonant elements of the block 2.

The electrical length t of the coupling elements 916 and 917, when defined so as to correspond to fc, is set in a range where an electrical length $t_{fc}$ of a half wavelength in a frequency range from fc−df/2 to fc+df/2 which is defined by fc and df, and integer multiples of the electrical length of this range are excluded, and is set, for example, in a range $0°<t<t_{fc}$ and $t_{fc}<t<2t_{fc}$. With this, it is possible to control the cross coupling by changing the electrical length and arrangement of the coupling elements.

Further, the undesirable cross couplings between the blocks is controlled by providing a coupling element 915 between the third resonant element of the block 1 and the second resonant element of the block 2.

The filter 90 can be made of a conductive material formed on an insulating substrate (not shown) as a dielectric substrate. The insulating substrate has a ground conductor on one face of the substrate, and a line conductor on the opposite face. The conductive material includes metals such as copper and gold, superconductors such as niobium and niobium-tin, and Y system copper oxide high-temperature superconductors. The substrate is made of various suitable materials such as magnesium oxide, sapphire, and lanthanum aluminate. For example, a superconducting microstrip line is formed on a magnesium oxide substrate (not shown) with a thickness of about 0.43 mm and a relative dielectric constant of about 10. Here, a Y system copper oxide high-temperature superconducting thin film having a thickness of about 500 nm is used as the superconductor of the microstrip line, and the line width of the strip conductor is about 0.4 mm. The superconducting thin film can be formed by a laser vapor deposition method, a sputtering method, a co-vapor deposition method, and the like.

(6) Sixth Embodiment

Figure 14:
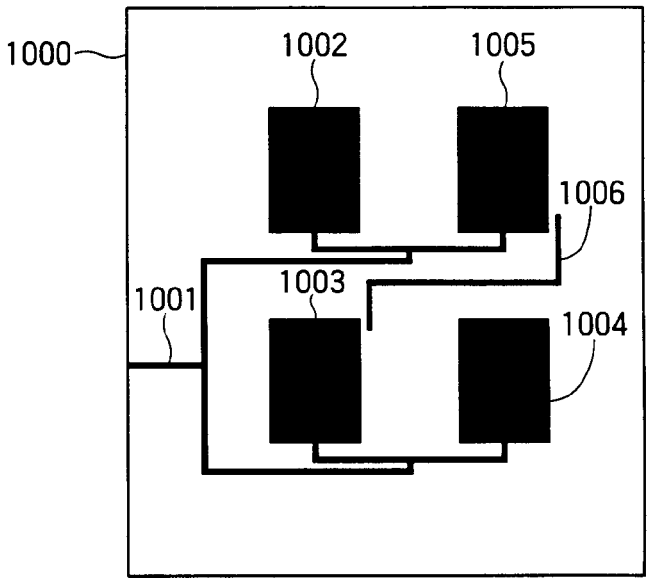
FIG. 14 is a plan view showing a constitution of a filter according to a sixth embodiment of the present invention.

FIG. 14 shows an antenna which is a sixth embodiment. An antenna 1000 is a four element array antenna which is connected to the outside by a transmission line of a feeding line 1001, and is constituted by four resonant elements 1002, 1003, 1004 and 1005 formed on a dielectric substrate on one face of which a ground conductor layer is formed. The resonant element is capable of taking various shapes such as a linear structure, circular and elliptic shapes, in addition to a rectangular patch structure shown in FIG. 14, and has an electric length which is a half wavelength at a center frequency fc according to a filter specification. It is possible to change the phase of each element by changing the feeding line 1001.

Here, the respective resonant elements are coupled with each other, and numbered counterclockwise from the resonant element 1002 in the figure such that the resonant element 1002 is designated as the first resonant element, the resonant element 1003 is designated as the second resonant element, the resonant element 1004 is designated as the third resonant element, and the resonant element 1005 is designated as the fourth resonant element. In order to selectively control the magnitude of the coupling between the resonant elements, for example, a coupling element 1006 for controlling the cross coupling is provided between the second and fourth resonant elements.

The coupling element 1006 may have various shapes. For example, the coupling element 1006 may have a line shape opened at both ends, and square, rectangular, cross, circular, elliptic shapes. Further, the coupling element 1006 may also have a line shape with a plurality of open ends, or other suitable shapes. It is possible to control the coupling between the resonant elements by changing the electrical length and arrangement of the coupling element.

The filter 1000 can be made of a conductive material formed on an insulating substrate (not shown) as a dielectric substrate. The insulating substrate has a ground conductor on one face of the substrate, and a line conductor on the opposite face. The conductive material includes metals such as copper and gold, superconductors such as niobium and niobium-tin, and Y system copper oxide high-temperature superconductors. The substrate is made of various suitable materials such as magnesium oxide, sapphire, and lanthanum aluminate. For example, a superconducting microstrip line is formed on a magnesium oxide substrate (not shown) with a thickness of about 0.43 mm and a relative dielectric constant of about 10. Here, a Y system copper oxide high-temperature superconducting thin film having a thickness of about 500 nm is used as the superconductor of the microstrip line, and the line width of the strip conductor is about 0.4 mm. The superconducting thin film can be formed by a laser vapor deposition method, a sputtering method, a co-vapor deposition method, and the like.

In this way, according to the present embodiment, the undesirable cross couplings which exist between the two resonant elements among the resonant elements 1002 to 1005 constituting the resonant circuit are controlled by using the coupling element 1006 which is newly arranged between the two resonant elements. Thus, it is possible to create a state where two resonant elements are not coupled with each other or a state where the amount of coupling between the two resonant elements is reduced, which states are difficult to realize on a plane, and to thereby improve the characteristics of the planar antenna.

(7) Seventh Embodiment

Figure 15:
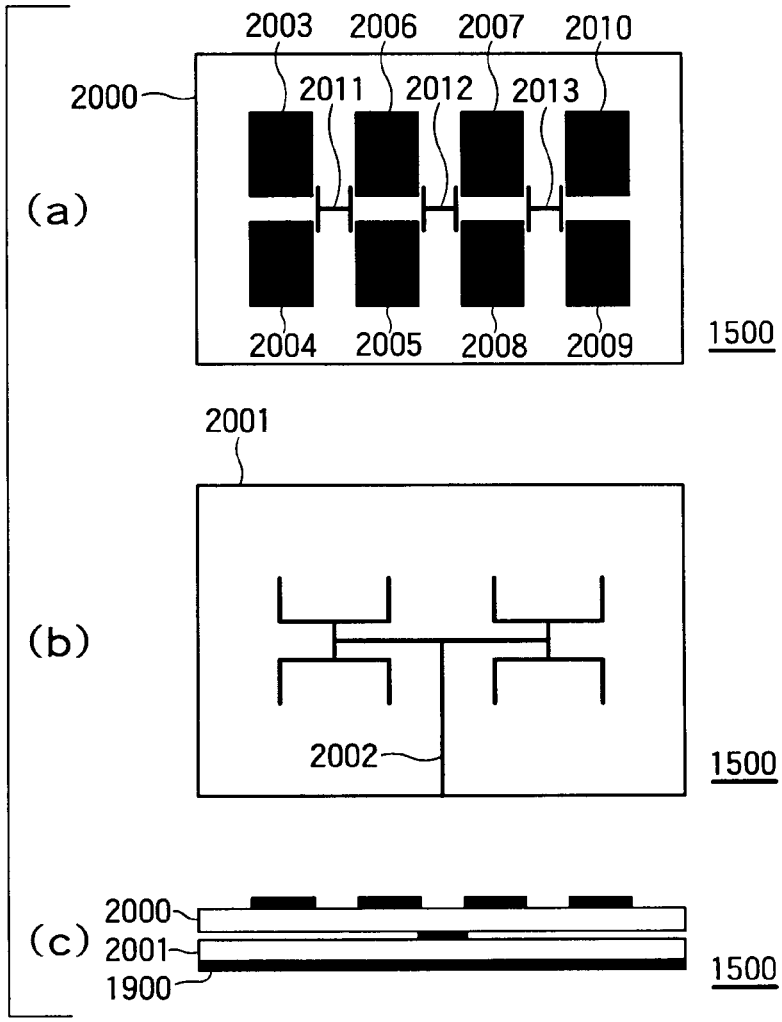
FIG. 15 is a plan view showing a constitution of a filter according to a seventh embodiment of the present invention.

FIG. 15 shows an antenna which is a seventh embodiment. The antenna 1500 is constituted by laminating a dielectric substrate 2001 on one face of which a ground conductor layer 1900 is formed, and on the other face of which a feeding line 2002 is provided, and a dielectric substrate 2000 on one face of which eight resonant elements 2003 to 2010 are provided. The antenna 1500 is connected to the outside by the feeding line 2002.

The antenna 1500 is an eight element array antenna constituted by the eight resonant elements 2003 to 2010. The resonant element is capable of taking various shapes such as a linear structure, circular and elliptic shapes, in addition to a rectangular patch structure as shown in FIG. 15, and has an electrical length which is a half wavelength at a center frequency fc according to a filter specification. It is possible to change the phase of each element by changing the shape of the transmission line of the feeding line 2002. Further, the phase of each element may also be changed by using a phase shifter. Further, it is also possible to directly supply electrical power to each resonant elements 2003 to 2010 by using via holes.

Here, the respective resonant elements 2003 to 2010 are coupled with each other, and four adjoining resonant elements 2003 to 2006 selected from the eight resonant elements 2003 to 2010 are numbered counterclockwise from the resonant element 2003 in the figure such that the resonant element 2003 is designated as the first resonant element, the resonant element 2004 is designated as the second resonant element, the resonant element 2005 is designated as the third resonant element, and the resonant element 2006 is designated as the fourth resonant element.

In order to selectively control the magnitude of the coupling between the resonant elements, for example, a coupling element 2011 for controlling the cross coupling is provided between the first and third resonant elements and between the second and fourth resonant elements. It is possible to control the coupling between the resonant elements by changing the electrical length, the arrangement, and the shape of the coupling element 2011. Further, the coupling element 2011 may have various shapes. For example, the coupling element 2011 may have a line shape opened at both ends, and square, rectangular, cross, circular, elliptic shapes. Further, the coupling element 2011 may have a line shape with a plurality of open ends, or other suitable shapes.

Similarly, the coupling between the resonant elements 2005 to 2008, which form another combination of adjoining resonant elements, can be controlled by a coupling element 2012 for controlling the cross coupling, and the coupling between the resonant elements 2007 to 2010 can be controlled by a coupling element 2013 for controlling the cross coupling.

The antenna 1500 can be made of a conductive material formed on the dielectric substrate 2000. The conductive material includes metals such as copper and gold, superconductors such as niobium and niobium-tin, and Y system copper oxide high-temperature superconductors. The substrate is made of various suitable materials such as magnesium oxide, sapphire, and lanthanum aluminate.

Note that the above described embodiments are examples, and the present invention is not limited to these examples. For example, the resonant elements may be arranged in multi-order with at least four or more, instead of four, six, and eight orders.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A filter circuit, in which first and second blocks each comprising resonant elements of a plurality of orders of at least four or more, and an input section and an output section which are connectable to the outside are arranged by forming a predetermined conductor pattern on a dielectric substrate, wherein for each of the first and second blocks, among the resonant elements of the plurality of orders, a first to fourth resonant elements constituting a desired four orders of the resonant elements are arranged to effect electromagnetic field couplings between the first and second resonant elements, between the second and third resonant elements, between the third and fourth resonant elements, and between the fourth and first resonant elements, the filter circuit comprising:

at least either a first coupling element which is arranged in a region on the dielectric substrate between the second and the fourth resonant elements, so as to effect an electromagnetic field coupling between the second and the fourth resonant elements, wherein the electromagnetic field coupling effected by the first coupling element has an inverse sign with respect to an undesirable cross-coupling occurring between the second and the fourth resonant elements to cancel the undesirable cross-coupling between the second and the fourth resonant elements, or a second coupling element which is arranged in a region on the dielectric substrate between the first and the third resonant elements, so as to effect an electromagnetic field coupling between the first and the third resonant elements, wherein the electromagnetic field coupling effected by the second coupling element has an inverse sign with respect to an undesirable cross-coupling occurring between the first and the third resonant elements to cancel the undesirable cross-coupling between the first and the third resonant elements, wherein, for each of the first and second blocks, electrical lengths of the first and second coupling elements are selected from a range except electrical lengths of integer multiples of a half wavelength of a wavelength in a range corresponding to a frequency range determined on the basis of a center frequency and a band width of the filter circuit, the first and second blocks are cascade-connected via respective ones of the resonant elements of the plurality of orders in each of the first and second blocks, the input section is coupled to a different one from the respective one of the resonant elements of the plurality of orders in the first block, the output section is coupled to a different one from the respective one of the resonant elements of the plurality of orders in the second block, and for each of the first and second blocks, no coupling element is arranged between the first and second resonant elements, between the second and third resonant elements, between the third and fourth resonant elements, and between the fourth and first resonant elements.

2. The filter circuit according to claim 1, wherein for each of the first and second blocks, each of the first and second coupling elements is constituted by a line which is opened at both ends.

3. The filter circuit according to claim 1, wherein for each of the first and second blocks, each of the first and second coupling elements is constituted by a line having a plurality of open ends.

4. The filter circuit according to claim 1, wherein a ground conductor is formed on the lower face of the dielectric substrate.

5. The filter circuit according to claim 1, wherein for each of the first and second blocks, the resonant element is formed by using a superconductor.

6. A filter circuit, in which resonant elements of a plurality of orders of at least four or more, and an input section and an output section which are connectable to the outside, are arranged by forming a predetermined conductor pattern on a dielectric substrate, wherein among the resonant elements of the plurality of orders, a first to fourth resonant elements constituting a desired four orders of the resonant elements are arranged to effect electromagnetic field coupling between the first and second resonant elements, between the second and third resonant elements, between the third and fourth resonant elements, and between the fourth and first resonant elements, the filter circuit comprising:

at least either a first coupling element which is arranged in a region on the dielectric substrate between the second and the fourth resonant elements, so as to effect an electromagnetic field coupling between the second and the fourth resonant elements, wherein the electromagnetic field coupling effected by the first coupling element has an inverse sign with respect to an undesirable cross-coupling occurring between the second and the fourth resonant elements to cancel the undesirable cross-coupling between the second and the fourth resonant elements, or a second coupling element which is arranged in a region on the dielectric substrate between the first and the third resonant elements, so as to effect an electromagnetic field coupling between the first and the third resonant elements, wherein the electromagnetic field coupling effected by the second coupling element has an inverse sign with respect to an undesirable cross-coupling occurring between the first and the third resonant elements to cancel the undesirable cross-coupling between the first and the third resonant elements, wherein, electrical lengths of the first and second coupling elements are selected from a range except electrical lengths of integer multiples of a half wavelength of a wavelength in a range corresponding to a frequency range determined on the basis of a center frequency and a band width of the filter circuit, the input section is coupled to the first resonant element, the output section is coupled to the fourth resonant element, and no coupling element is arranged between the first and second resonant elements, between the second and third resonant elements, between the third and fourth resonant elements, and between the fourth and first resonant elements.

* * * * *